US008070156B2

(12) United States Patent
Yoda et al.

(10) Patent No.: US 8,070,156 B2
(45) Date of Patent: Dec. 6, 2011

(54) SHEET ADSORPTION DEVICE, TRANSPORT DEVICE, AND IMAGE FORMING APPARATUS

(75) Inventors: Kaneo Yoda, Okaya (JP); Takato Hayashi, Minowa-machi (JP); Yasushi Yajima, Minowa-machi (JP); Satoru Shiohara, Shiojiri (JP); Satoshi Kaneta, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 134 days.

(21) Appl. No.: 12/186,982

(22) Filed: Aug. 6, 2008

(65) Prior Publication Data

US 2009/0039595 A1 Feb. 12, 2009

(30) Foreign Application Priority Data

Aug. 7, 2007 (JP) ..... 2007-205039
May 21, 2008 (JP) ..... 2008-132801

(51) Int. Cl.
*B65H 29/32* (2006.01)

(52) U.S. Cl. ..... 271/196; 271/194; 271/197; 271/276

(58) Field of Classification Search ..... 271/276, 271/197, 194, 196; 347/104
See application file for complete search history.

(56) References Cited

U.S. PATENT DOCUMENTS 2,753,181 A * 7/1956 Anander Andrew K ..... 226/95
4,479,435 A 10/1984 Takeuchi et al.
5,374,021 A * 12/1994 Kleinman ..... 248/362
6,254,090 B1 * 7/2001 Rhodes et al. ..... 271/276
6,270,074 B1 * 8/2001 Rasmussen et al. ..... 271/276
6,371,430 B1 * 4/2002 Vernackt ..... 248/362
6,682,191 B2 * 1/2004 Temple et al. ..... 347/104
7,651,091 B2 * 1/2010 McNally et al. ..... 271/276

FOREIGN PATENT DOCUMENTS

CN 2554138 Y 6/2003
DE 203 13 841 U1 11/2003
GB 2 111 647 A 7/1983
JP 06135613 A * 5/1994
JP 2003-159841 6/2003

OTHER PUBLICATIONS

Extended European Search Report dated Apr. 21, 2011 issued in corresponding European Application No. 08013985.0.

* cited by examiner

*Primary Examiner* — Stefanos Karmis
*Assistant Examiner* — Luis A Gonzalez
(74) *Attorney, Agent, or Firm* — Workman Nydegger

(57) ABSTRACT

A sheet adsorption device includes a sheet adsorbing surface, a suction hole disposed on the sheet adsorbing surface, and a flow path shifting unit that shifts between a first state and a second state of a communication flow path that is communicated with the suction hole in accordance with existence of a sheet that covers the suction hole. The cross-section area of a flow path in the second state is smaller than that in the first state and the communication flow path is not closed in the second state.

10 Claims, 9 Drawing Sheets

SHEET ADSORPTION DEVICE, TRANSPORT DEVICE, AND IMAGE FORMING APPARATUS

BACKGROUND

1. Technical Field

The present invention relates a sheet adsorption device, a transport device using the sheet adsorption device, and an image forming apparatus using the sheet adsorption device and the transport device.

2. Related Art

As devices that adsorb a sheet such as a recording medium, devices that adsorb one surface of a sheet by using a negative pressure generating unit have been known. In addition, devices using a method of pressing a sheet by using a unit using an electrostatic force, a magnet, or the like have been known.

A device that adsorbs a sheet by using the negative pressure generating unit has an advantage that affect of static electricity for electric components is small. In addition, since the device does not have a magnet or the like on one surface of a sheet, there are advantages that almost the entire area of one surface of the sheet can be used for a print operation and the like.

An adsorption unit that performs an suction operation through an air hole formed on a support plate by using a negative pressure generating unit with a porous belt having a adsorption surface, on which a plurality of air holes is formed, moved on a support plate having a plurality of holes and fixing a recording medium to the adsorption surface having the holes has been known (for example, see Japanese Patent 3707640 (pages 4 to 5, FIG. 3).

When a suction operation is performed by using all the plurality of air holes all the time, the ratio of air holes covered with a recording medium to air holes not covered with the recording medium is changed in a case where the size of the recording medium located on the adsorption surface having the holes changes. Accordingly, a stable adsorption effect cannot be acquired, or noise increases due to generation of an airflow. Thus, the adsorption surface having a plurality of holes corresponding to the size of the recording medium is disposed in the porous belt in advance.

When the size of a recording medium does not correspond to the adsorption surface having the holes which is disposed in advance or a recording medium is deviated from the adsorption surface having the holes due to tilt of the recording medium, a stable adsorption effect cannot be acquired, or an air flow is generated so as to increase noise. In addition, the load of the negative generating unit changes, and accordingly, redundant power is needed.

SUMMARY

An advantage of some aspects of the invention is that it provides a sheet adsorption device, a transport device, and an image forming apparatus. The invention may be implemented as the following embodiments or application examples.

APPLICATION EXAMPLE 1

There is provided a sheet adsorption device including: a sheet adsorbing surface; a suction hole disposed on the sheet adsorbing surface; and a flow path shifting unit that shifts between a first state and a second state of a communication flow path that is communicated with the suction hole in accordance with existence of a sheet that covers the suction hole.

The cross-section area of a flow path in the second state is smaller than that in the first state and the communication flow path is not closed in the second state.

According to this application example, the cross-section area of the flow path of the communication flow path that is communicated with suction holes not covered with a sheet is smaller than that of the communication flow path that is communicated with suction holes covered with the sheet. In addition, the flow path switching unit selects the cross-section area of the flow path in accordance with existence of a sheet that covers the suction holes. Accordingly, the flow of gas in the suction holes not covered with the sheet becomes slow. On the other hand, in the suction holes covered with the sheet, since the communication flow path is not closed. Accordingly, the flow of gas is scarcely generated, and thereby a change of the load for the suction operation is small. Thus, a stable suction force can be acquired regardless of the size and tilt of the sheet to be adsorbed. In addition, since noise and variances of load for suction due to the flow of air are small, the sheet adsorption device that has decreased power consumption can be acquired.

APPLICATION EXAMPLE 2

In the above-described sheet adsorption device, the flow path shifting unit includes: a first static pressure cell that is communicated with the suction hole; a second static pressure cell that is communicated with the first static pressure cell; and a valve that partially opens or closes the communication flow path between the first static pressure cell and the second static pressure cell in accordance with a differential pressure between the first static pressure cell and the second static pressure cell.

In this application example, when a suction hole is not covered with a sheet, the pressure inside the suction hole becomes higher than that inside the second static pressure cell in which the pressure inside the first static pressure cell which is close to the atmospheric pressure is sucked. In such a case, the cross-section area of the flow path of gas between the first static pressure cell and the second static pressure cell is decreased by the valve that partially opens or closes the communication flow path, and accordingly, the flow of gas inflowing from the suction hole becomes slow. On the other hand, when a suction hole is covered with the sheet, the flow of gas from the suction hole is substantially blocked. Accordingly, the pressures inside the first and second static pressure cells become almost a same negative pressure, and thereby the sheet is adsorbed. As a result, the suction hole covered with the sheet is mainly sucked, and accordingly, a stable suction force can be acquired regardless of the size and tilt of the sheet to be adsorbed. In addition, since noise and variances of load for suction due to the flow of air are small, the sheet adsorption device that has decreased power consumption can be acquired.

APPLICATION EXAMPLE 3

In the above-described sheet adsorption device, the communication flow path includes a first flow path part and a second flow path part, and the valve opens or closes the first flow path part.

In this application example, since the valve opens or closes the first flow path part, the communication flow path is communicated with the second flow path part. Thus, the gas passes through the second flow path part even in a case where the valve is closed, and thereby it is easy to control the pressure of the valve inside the communication flow path on both sides.

APPLICATION EXAMPLE 4

In the above-described sheet adsorption device, the valve has a diaphragm that is disposed between the first static pressure cell and the second static pressure cell.

In this application example, since the valve partially opens the communication flow path between the first static pressure cell and the second static pressure cell by using the diaphragm, the flow path shifting unit is configured as a simple structure. Accordingly, the flow path shifting unit is decreased in size and thickness, and thereby the sheet adsorption device that is decreased in size and thickness can be acquired.

APPLICATION EXAMPLE 5

In the above-described sheet adsorption device, the flow path shifting unit includes: a first plate-shaped member in which a through-part configuring the first static pressure cell is formed; a second plate-shaped member in which a through-part configuring the second static pressure cell is formed; and a third plate-shaped member that is disposed between the first plate-shaped member and the second plate-shaped member and has the diaphragm formed therein.

In this application example, since the flow path shifting unit is configured as a simple structure that is formed by laminating plate-shaped members, power supply from the outside is not needed for selecting a suction hole covered with the sheet. Accordingly, the sheet adsorption device that has decreased power consumption can be acquired. In addition, since the flow path shifting unit is configured as a laminated structure, the flow path shifting unit can be decreased in size and thickness, and thereby the sheet adsorption device that is decreased in size and thickness can be acquired.

APPLICATION EXAMPLE 6

In the above-described sheet adsorption device, the diaphragm is supported on both sides in a direction that is approximately perpendicular to at least one direction by a support part that is supported on both sides in at least the one direction by a base body of the third plate-shaped member.

In this application example, the valve has so-called a gimbal structure. Accordingly, when the diaphragm is moved, inclination of the diaphragm with respect to the flow of gas can be decreased. Accordingly, the flow of gas is controlled to be reproduced well by the diaphragm, and thereby the sheet adsorption device that can correctly select suction holes that are covered with the sheet can be acquired.

APPLICATION EXAMPLE 7

In the above-described sheet adsorption device, the diaphragm includes a through hole used for communicating the first static pressure cell and the second static pressure cell with each other in the second state.

In this application example, the movement of the diaphragm due to the flow of gas is controlled by changing the size of the communication hole. In addition, appropriate movement of the diaphragm is selected in accordance with a case where the suction hole is covered with a sheet or not. Thereby the sheet adsorption device that can correctly select suction holes that are covered with the sheet can be acquired.

APPLICATION EXAMPLE 8

In the above-described sheet adsorption device, the flow path shifting unit includes: a first plate-shaped member in which a through-part configuring the first static pressure cell is formed; a second plate-shaped member in which a through-part configuring the second static pressure cell is formed; a third plate-shaped member that is disposed between the first plate-shaped member and the second plate-shaped member and has the diaphragm formed therein; and a fourth plate-shaped member which is pinched by the second plate-shaped member and the third plate-shaped member and a through-part configuring a valve casing of the valve is formed in.

In this application example, the valve casing is formed by laminating plate-shaped members in which a through-part is formed, instead of processing a base material. Accordingly, the precision of the shape is improved, and the costs are reduced.

APPLICATION EXAMPLE 9

In the above-described sheet adsorption device, the valve has a valve body that is disposed to be able to be displaced between the first static pressure cell and the second static pressure cell, and the valve body is commonly biased in a direction in which the communication flow path is in the first state by a biasing force of the biasing member, and is displaced in a direction in which the communication flow path is the second state in resistance to the biasing force in a case where a differential pressure between the first static pressure cell and the second static pressure cell exceeds the biasing force of the biasing member.

In this application example, the cross-section area of the flow path of the communication flow path is changed by displacing the valve body that is biased by the biasing member in accordance with differential pressure between the first static pressure cell and the second static pressure cell. Accordingly, the flow path shifting unit is configured as a simple structure. In other words, when a suction hole is not covered with a sheet, the pressure inside the first static pressure cell which is close to the atmospheric pressure is higher than that inside the second static pressure cell. Accordingly, when the differential pressure between the first and second static pressure cells exceeds the biasing force of the biasing member, the valve body is displaced in the direction in which the communication flow path is in the second state for decreasing the cross-section area of the flow path of the communication flow path in resistance to the biasing force of the biasing member, and thereby decreasing the flow of gas inflowing from the suction hole. On the other hand, when a suction hole is covered with a sheet, the flow of gas from the suction hole into the first static pressure cell is substantially blocked, and the pressure of the first static pressure cell and that of the second static pressure cell become almost the same. Accordingly, the biasing force of the biasing member becomes stronger than a negative pressure applied to the valve body, and the valve body is displaced in a direction for increasing the cross-section area of the flow path of the communication flow path based on the biasing force. Accordingly, suction from the suction hole not covered with a sheet is suppressed, and a suction force can be appropriately applied to the sheet.

APPLICATION EXAMPLE 10

In the above-described sheet adsorption device, the valve has a valve seat on which the valve body displaced in the direction, in which the communication flow path is the second state, in resistance to the biasing force of the biasing member is seated, and, in at least one between the valve body and the valve seat, a communicating part used for communicating the first static pressure cell and the second static pressure cell in the second state.

In this application example, the communicating part is formed in at least one between the valve body and the valve seat. Thus, even when the valve body is displaced in a direction in which the communication flow path is in the second state for decreasing the cross-section area of the flow path of the communication flow path, the first static pressure cell and the second static pressure cell are communicated with each other through the communicating part. Accordingly, the flow path shifting unit is configured as a simple structure.

APPLICATION EXAMPLE 11

There is provided a transport device that transports a sheet by adsorbing the sheet to a sheet adsorbing surface. The transport device includes a moving part of the sheet adsorbing surface and the above-described adsorption device.

According to this application example, since the above-described sheet adsorption device is included, a stable suction force can be acquired regardless of the size and tilt of the sheet to be adsorbed. In addition, since noise and variances of load for suction due to the flow of air are small, the transport device that has decreased power consumption can be acquired.

APPLICATION EXAMPLE 12

There is provided an image forming apparatus that forms an image on a sheet. The image forming apparatus includes the above-described sheet adsorption device or the above-described transport device.

According to this application example, since the above-described adsorption device or the above-described transport device is included, a stable suction force can be acquired regardless of the size and tilt of the sheet to be adsorbed. In addition, since noise and variances of load for suction due to the flow of air are small, the image forming apparatus that has decreased power consumption can be acquired.

In addition, even for a large-size image forming apparatus that uses roll part for which a transport device is not used, same advantages can be acquired by directly adsorbing and transporting the roll paper to the sheet adsorption device.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the accompanying drawings.

First Embodiment

Figure 1:
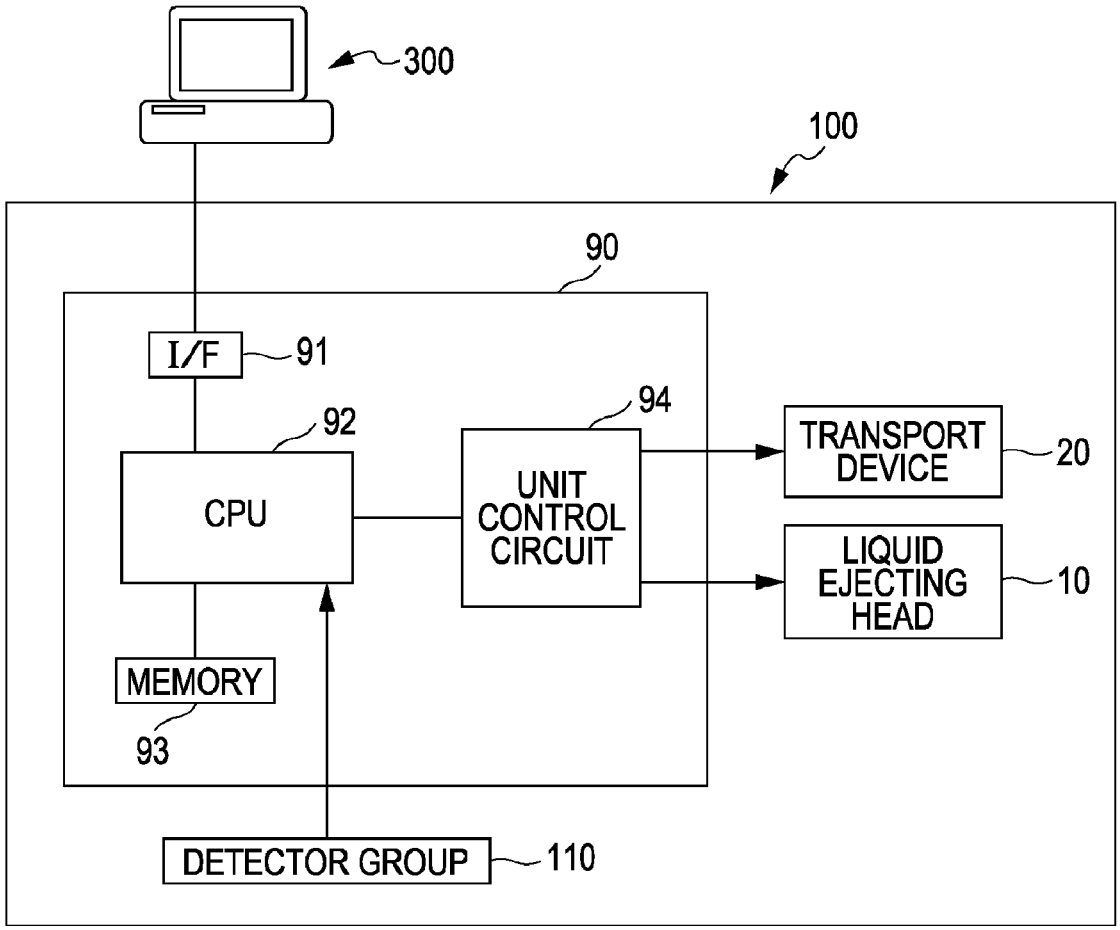
FIG. 1 is a block diagram of the whole configuration of an image forming apparatus according to a first embodiment of the invention.

FIG. 1 is a block diagram showing the whole configuration of an image forming apparatus 100 according to a first embodiment.

The image forming apparatus 100 that has received print data from a computer 300 as an external apparatus controls a transport device 20 and a liquid ejecting head 10 by using a controller 90 and forms an image on a recording medium S as a sheet. In addition, a detector group 110 monitors the status inside the image forming apparatus 100, and the controller 90 controls the transport device 20 and the liquid ejecting head 10 based on the result of detection.

The controller 90 is a control unit that performs an operation for controlling the image forming apparatus 100. An interface unit (I/F) 91 is used for data transmission and data reception between the computer 300 and the image forming apparatus 100. A CPU 92 is an arithmetic processing unit that is used for controlling the overall image forming apparatus 100. A memory 93 is used for acquiring an area for storing a program of the CPU 92, a work area, or the like. The CPU 92 controls the transport device 20 and the liquid ejecting head 10 in accordance with the program stored in the memory 93 by using a unit control circuit 94.

Figure 2:
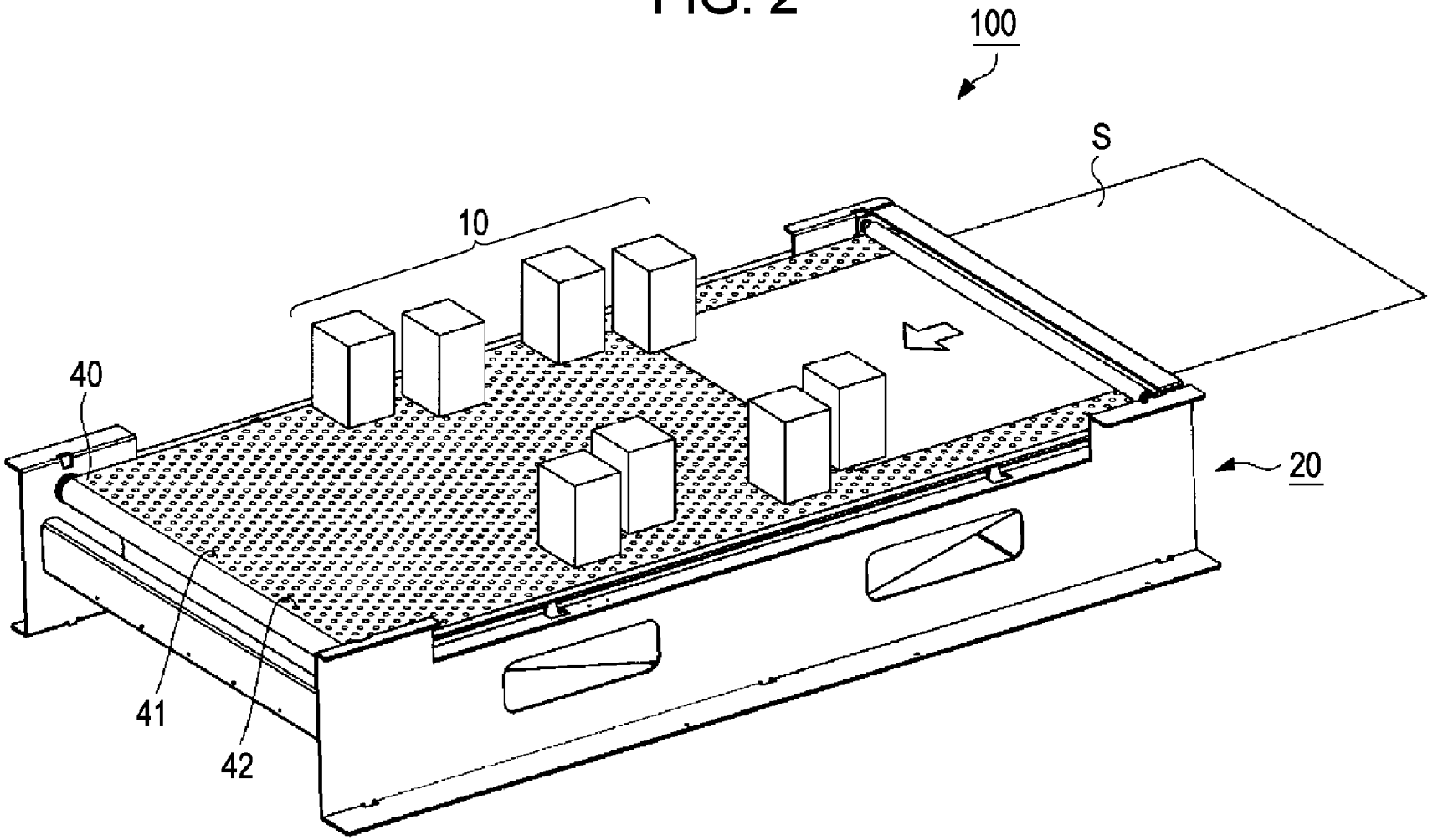
FIG. 2 is a schematic partial cross-section view of the image forming apparatus.
Figure 3:
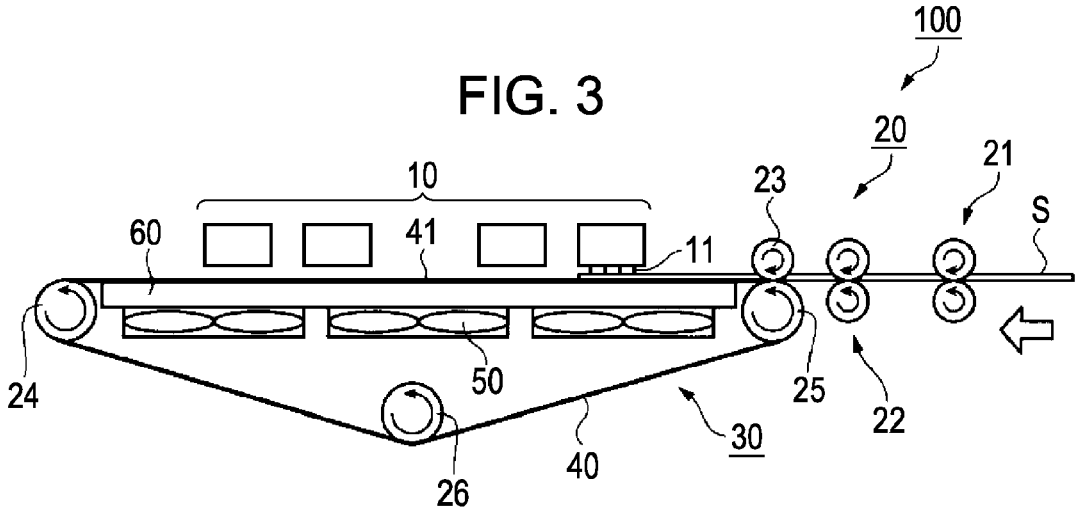
FIG. 3 is a schematic cross-section view of the image forming apparatus.

FIG. 2 is a schematic partial cross-section view of the image forming apparatus 100 according to this embodiment. In addition, FIG. 3 shows a schematic cross-section view of the image forming apparatus 100.

As shown in FIG. 2, the image forming apparatus 100 includes a plurality of the liquid ejecting heads 10 and the transport device 20. The image forming apparatus 100 according to this embodiment is a device called a line printer and is a color image forming apparatus that forms an image by ejecting ink. In FIG. 2, not all the liquid ejecting heads 10 are shown.

In FIG. 2, the transport direction of the recording medium S is denoted by an outline arrow. The recording medium S is transported by the transport device 20.

In FIG. 2, the liquid ejecting heads 10 are disposed in a position for facing one surface of the recording medium S that is transported by the transport device 20. In addition, the liquid ejecting heads 10 are arranged in four lines such that each line is formed in a direction perpendicular to the transport direction of the recording medium S. Two lines of the four lines configure one set. The pitch of two lines of one set is small, and the pitch of two sets is large.

In addition, the liquid ejecting heads 10 of the two lines of one set are disposed such that one line is aligned to be aside from the other line in a direction perpendicular to the transport direction of the recording sheet S, and are disposed in the shape of so-called a zigzag pattern.

As shown in FIG. 3, the transport device 20 includes a feed roller 21, a gate roller 22, a paper pressing roller 23, and a sheet adsorption device 30. In the figure, the rotation directions of the rollers are denoted by solid-line arrows.

The recording medium S is fed to the transport device 20 by the feed roller 21. Next, the recording medium S is sent to the sheet adsorption device 30 by the gate roller 22 and the paper pressing roller 23.

The recording medium S is adsorbed onto the sheet adsorption device 30 and is transported to a position to which ink 11 is ejected from the liquid ejection heads 10 by the transport device 20.

The sheet adsorption device 30 includes a belt 40 that is a moving part and a fan 50 and a static pressure control unit 60 that correspond to a suction unit. The static pressure control unit 60 is disposed between the belt 40 and the fan 50.

The belt 40 is suspended over a driving roller 24 and driven rollers 25 and 26 that are disposed to be separated from each other and is disposed to be rotatable in the counterclockwise direction.

In FIGS. 2 and 3, one surface of the belt 40 is a sheet adsorbing surface 41, and a plurality of suction holes 42 is formed on the sheet adsorbing surface 41. In the belt 40, the suction holes 42 are disposed so as to form rows in the transport direction of the belt 40. The suction holes 42 of adjacent rows are disposed to be aside in the transport direction and are disposed in the form of so-called a zigzag pattern. The suction holes 42 are disposed in an approximately entire area of the sheet adsorbing surface 41 of the belt 40.

The recording medium S is adsorbed to the sheet adsorbing surface 41, and is transported by the belt 40.

Hereinafter, the sheet adsorption device 30 will be described in detail.

Figure 4:
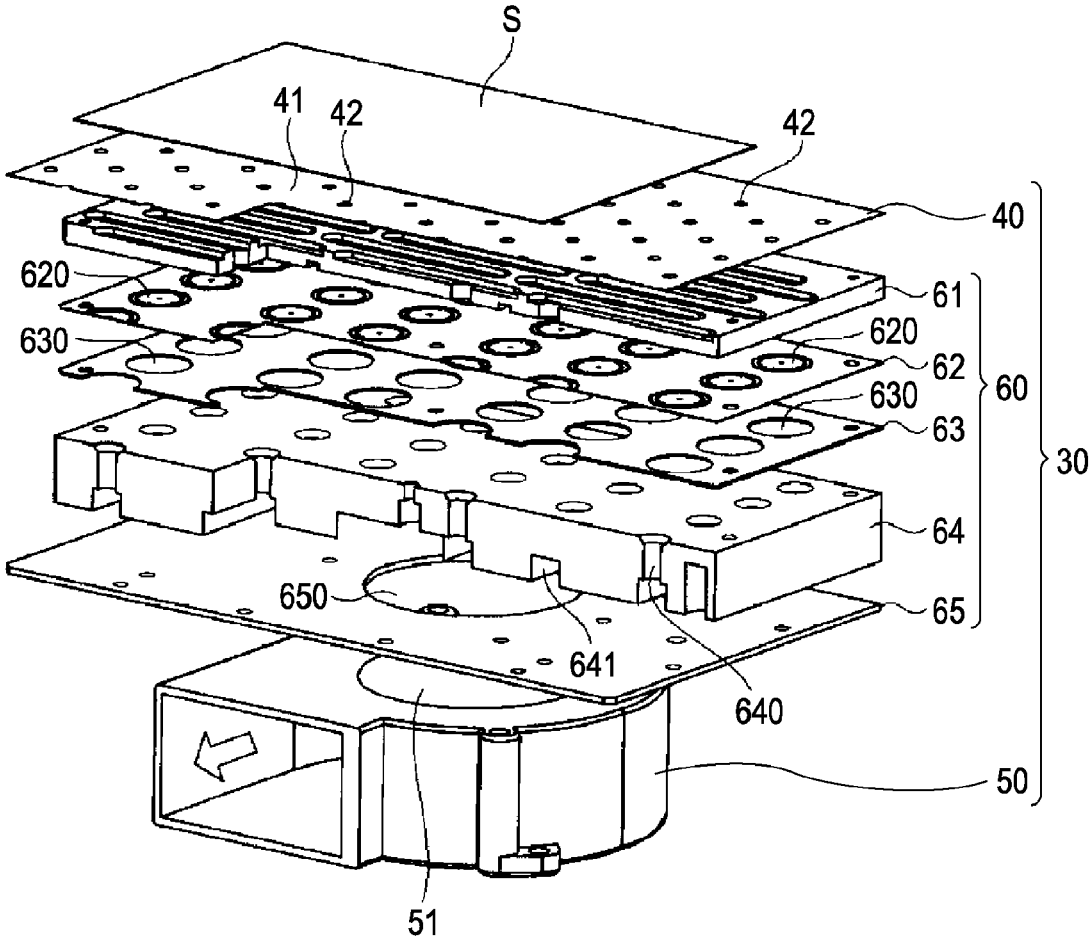
FIG. 4 is a partial exploded perspective view of a sheet adsorption device according to an embodiment of the invention.

FIG. 4 is a partial exploded perspective view of the sheet adsorption device 30. In the figure, the recording medium S is shown together.

The sheet adsorption device 30 includes a belt 40, a fan 50, and a static pressure control unit 60.

The static pressure control unit 60 is disposed between the belt 40 and the fan 50 and controls a suction process of each suction hole 42.

The belt 40 may be formed of a resin film. However, it is preferable that the belt is formed of a material that has flexibility and low elasticity.

The fan 50 has a rotation blade that is driven by a motor so as to generate a negative pressure. An outline arrow shown in FIG. 4 denotes the direction of air emission. As a negative pressure generating unit, a piston-type negative pressure generating unit other than the fan 50 may be used.

The static pressure control unit 60 includes a belt receiving plate 61 as a first plate-shaped member, a valve plate 62 and a spacer plate 63 as a third plate-shaped member, and a main body 64 and a sealing plate 65 as a second plate-shaped member.

The belt receiving plate 61, the valve plate 62, the spacer plate 63, the main body 64, and the sealing plate 65 are laminated from the belt 40 side toward the fan 50 side in the mentioned order.

Figure 5:
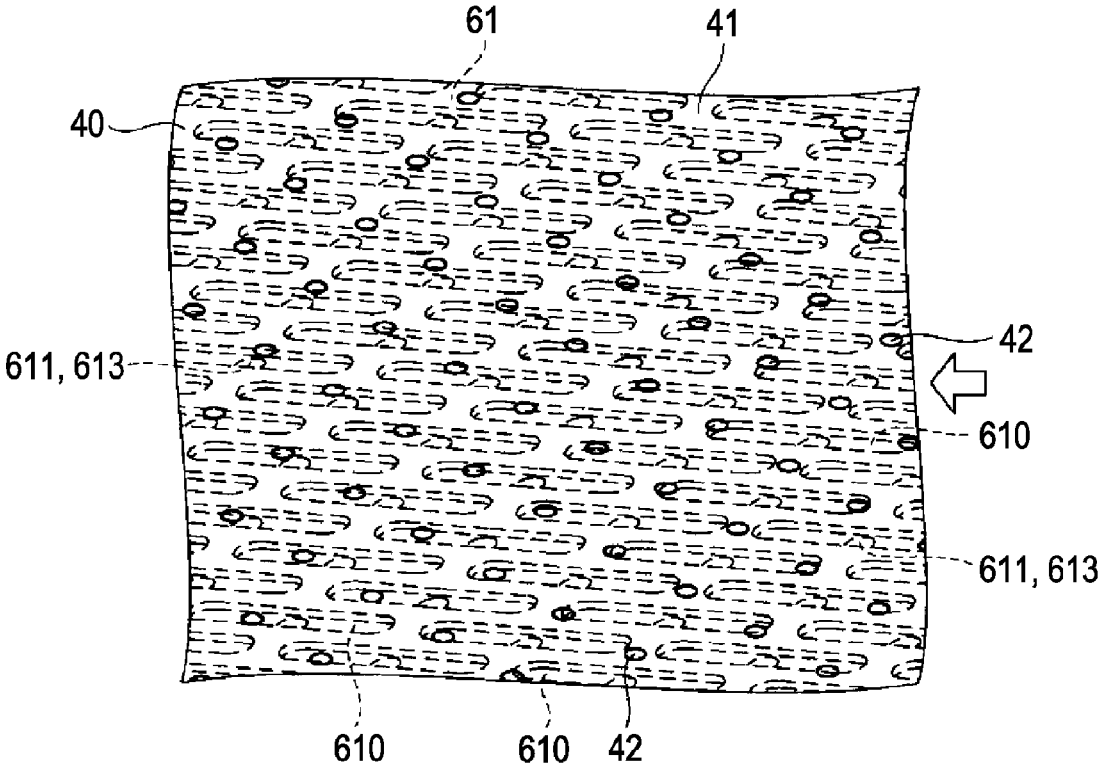
FIG. 5 is a perspective view of a belt and a belt receiving plate viewed from a sheet adsorbing surface side according to an embodiment of the invention.

FIG. 5 shows a perspective view of the belt 40 and the belt receiving plate 61 viewed from the sheet adsorbing surface 41 side. The transport direction of the recording medium S is denoted by an outline arrow.

In the belt receiving plate 61, a plurality of grooves 610 is formed in the form of a zigzag pattern along the row of the suction holes 42 in the transport direction of the recording medium S. Each grove 610 is formed to be thin and long in the transport direction of the recording medium S. The length of each groove 610 in the transport direction of the recording medium S is formed to be equivalent to the pitch of two suction holes 42 that are aligned in the row of the transport direction of the recording medium S such that one of the suction holes 42 is fitted into the groove 610 even in a case where the suction holes 42 are moved in accordance with movement of the belt 40.

Accordingly, even when the belt 40 is moved in the transport direction, a suction hole 42 formed in the belt 40 is fitted into one of the grooves 610 aligned in the transport direction.

On the bottom of the groove 610, one through-part (hole) is formed as a first static pressure cell 611. A plurality of the through-parts may be disposed, and the through-part may be disposed in any position of the bottom of the groove 610.

It is preferable that the belt receiving plate 61 is formed of a material that is not easily deformed. For example, metal, resin, or the like may be used as the material.

Figure 6:
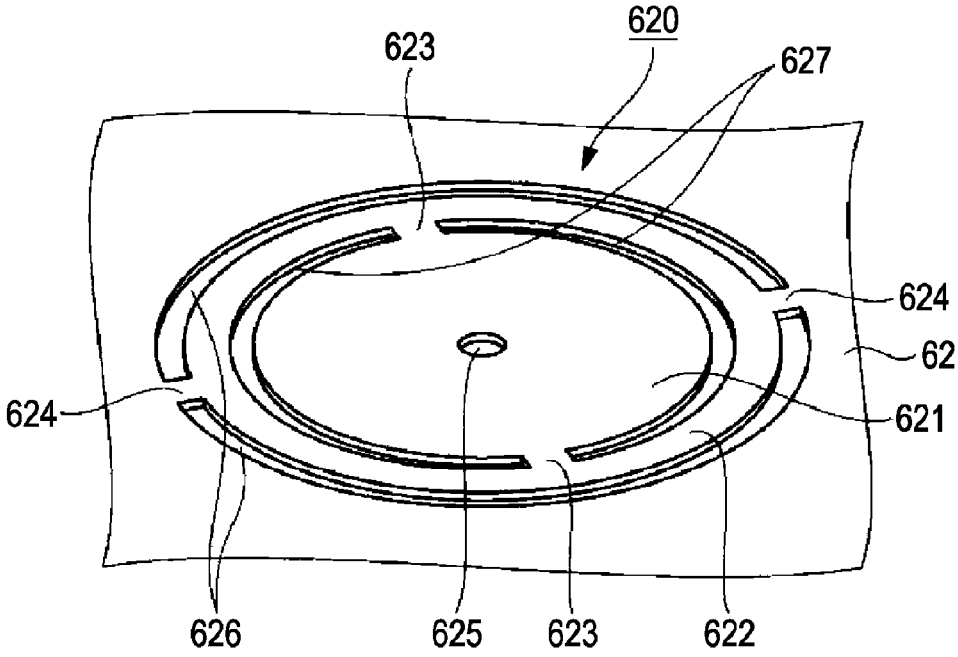
FIG. 6 is an enlarged diagram of a valve according to an embodiment of the invention.

As shown in FIG. 4, in the valve plate 62, a plurality of valves 620 is formed in accordance with the positions of the first static pressure cells 611. FIG. 6 is an enlarged diagram of one valve 620.

As shown in FIG. 6, the valve 620 includes a diaphragm 621, a support part 622, a first arm 623, and a second arm 624.

Both sides of the diaphragm 621 are supported at the support part 622 that is in a state of a ring by two of the first arms 623 formed in one direction. In addition, both sides of the support part 622 are supported at a base body that becomes an area outside the value 620 of the valve plate 62 by two of the second arms 624 formed in a direction perpendicular to the first arm 623. As described above, the valve 620 has so-called a gimbal structure in which one pair of the first arm 623 and the second arm 624 formed to be on a straight line supports the diaphragm 621 with maintaining different distances from the center and the valve can be displaced in the direction of thickness of the first arm 623 and the second arm 624.

The diaphragm 621 has a disk shape and has a through hole 625 formed on its center.

Between the support part 622 and the base body of the valve plate 62, a slit 626 is formed. In addition, between the support part 622 and the diaphragm 621, a slit 627 is formed.

The valve plate 62 and the valve 620 can be formed by etching or punching metal or molding or punching a resin.

In FIG. 4, in the spacer plate 63 as a fourth plate-shaped member, a plurality of through-parts 630 as valve casings is formed along the valve 620. The size of the opening part of each through-part 630 is equivalent to that of the valve 620.

In the main body 64, a plurality of through-parts (holes) as second static pressure cells 640 is formed in accordance with the diaphragm 621. The size of the opening part of each second static pressure cell 640 is formed to be smaller than that of the diaphragm 621.

In addition, the plurality of the second static pressure cells 640 is configured to be communicated with a flow path 641.

In the sealing plate 65, a hole 650 is formed along a suction opening 51 of the fan 50. In addition, the suction opening 51 of the fan 50 is communicated with the flow path 641 through a hole 650. Accordingly, the second static pressure cells 640 are communicated with the fan 50.

Figure 7:
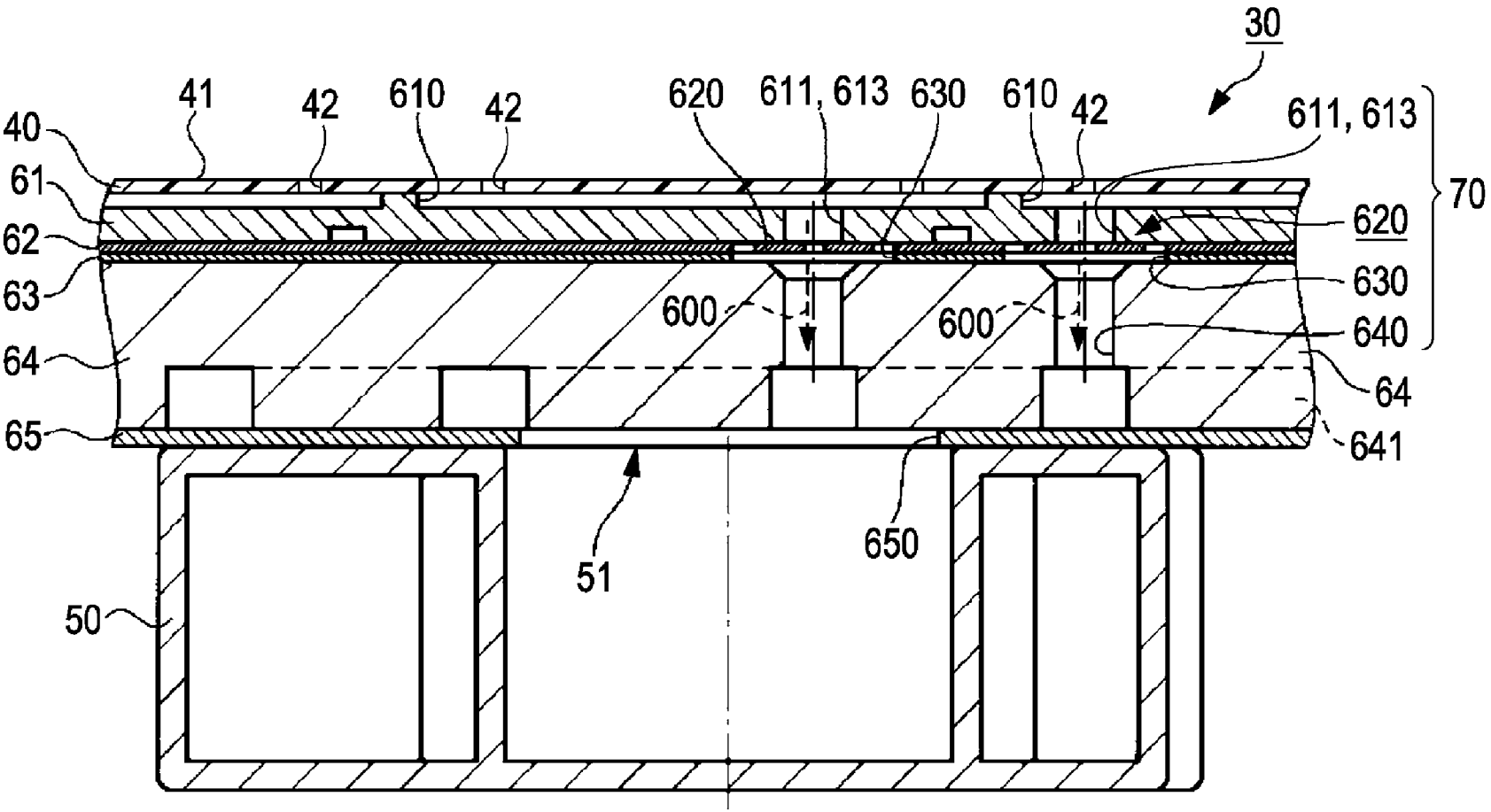
FIG. 7 is a partial cross-section view of a sheet adsorption device according to an embodiment of the invention.

FIG. 7 is a partial cross-section view of the sheet adsorption device 30.

The sheet adsorption device is configured such that the center of the hole of the first static pressure cell 611, the center of the hole of the second static pressure cell 640, and the center of the valve 620 are disposed to be on an axis denoted by a dashed line. The first static pressure cell 611 and the second static pressure cell 640 are communicated with each other through the valve 620 so as to configure a communication flow path 600. The communication flow path 600 is denoted by a dashed arrow.

Here, the first static pressure valve 611, the valve 620, the through-part 630, and the second static pressure valve 640 configures a flow path shifting unit 70 that switches between first and second states of the communication flow path 600.

Hereinafter, movement of the valve 620 of the flow path shifting unit 70 and the first and second states of the communication flow path 600 will be described in detail.

Figure 8:
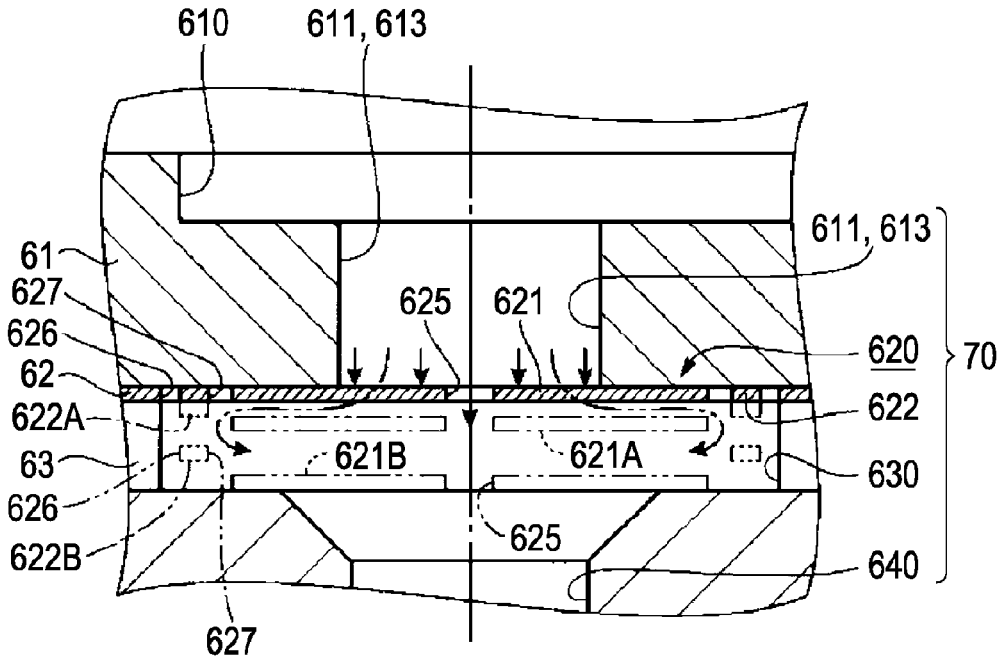
FIG. 8 is an enlarged cross-section view around a flow path shifting unit according to an embodiment of the invention.

FIG. 8 shows an enlarged cross-section view around the flow path shifting unit 70. In the figure, arrows represent the flow path of gas in a case where the gas is sucked by the fan 50.

In the valve 620, the slit 626 between the support part 622 and the valve plate 62 and the slit 627 between the support part 622 and the diaphragm 621 configure a first flow path part, and the through-hole 625 configures a second flow path part.

A solid arrow represents the flow of gas through the second flow path part, and a dashed-two dotted arrow represents the flow of gas through the first flow path part.

In FIGS. 7 and 8, when the suction hole 42 of the belt 40 is covered with the recording medium S, the amount of flow of gas from the suction hole 42 is small. In addition, the first static pressure cell 611 and the second static pressure cell 640 are communicated with each other through the through-hole 625. In such a case, since pressure compensation due to the flow of the gas from the suction hole 42 is small, a difference between the pressure inside the first static pressure cell 611 and the pressure inside the second static pressure cell 640 is not large. Accordingly, a force due to the flow of the gas is not applied much to the diaphragm 621.

The diaphragm 621 is stopped in a position 621A in which a force applied to the diaphragm 621 due to the suction force of the fan 50, the size of the through-hole 625, and the like and a restoring force due to the spring force of the first and second arms 623 and 624 shown in FIG. 6 are balanced. In addition, the support part 622 is stopped in a position 622A denoted by a dotted line. Here, when the width of the support part 622 is large, it is difficult for the diaphragm 621 to respond.

The gas flows through the first flow path part (a path passing through the slit 626 and the slit 627) and the second flow path part (a path passing through the through-hole 625). This state is the first state of the communication flow path 600.

On the other hand, when the suction hole 42 of the belt 40 is not covered with the recording medium S, the pressure inside the first static pressure cell 611 is close to the atmospheric pressure. In addition, the pressure inside the second static pressure cell 640 that is sucked by the fan 50 is a negative pressure. Accordingly, the gas flows so as to press the diaphragm 621 in the direction of the second static pressure cell 640.

The diaphragm 621 moves inside the through-part 630 against the spring forces of the first and second arms 623 and 624 shown in FIG. 6 and closes the opening part of the second static pressure cell 640 in a position 621B denoted by a dotted line. In addition, the support part 622 is stopped in a position 622B denoted by a dotted line.

The gas flows through the second flow path part. This state is the second state of the communication flow path 600.

The second state is a state in which the cross section area of the flow path is smaller than that of the first state and the communication flow path 600 is not closed by the second flow path part. Accordingly, even when the suction hole 42 is not covered with the recording medium S and the communication flow path 600 is in the second state, the gas is sucked a little from the suction hole 42.

When this state is transited to a state in which the suction hole 42 is covered with the recording medium S, the pressure of the first static pressure cell 611 decreases due to a decrease of the flow of gas from the suction hole 42, and the diaphragm 621 is moved in a position denoted by 622A.

Here, a case where a through-hole 625 is not formed in the diaphragm 621 will be considered. In such a case, in a state that the suction hole 42 is not covered with the recording medium S, the diaphragm 621 is in a position 621B, and accordingly, the communication flow path 600 is completed closed.

When the communication flow path 600 is closed at once in this state, suction from the suction hole 42 is not performed at all even in a case where the suction hole 42 is covered with the recording medium S thereafter. Accordingly, the recording media S is not adsorbed.

In other words, the inside of the first static pressure cell 611 is in an atmospheric pressure state, and the second static pressure cell 640 is in a negative pressure state due to the fan 50.

As described above, the reason that the communication flow path 600 is configured not to be completely closed in the second state is that the pressure of the first static pressure cell 611 is changed in accordance of existence of a recording medium S that covers the suction hole 42.

When the through-hole 625 is formed, the pressure inside the first static pressure cell 611 is changed in accordance with existence of a recording medium S that covers the suction hole 42.

The through-hole 625 may be disposed in the belt receiving plate 61, the valve plate 62, the spacer plate 63, and the main body 64, so that the first static pressure cell 611 and the second static pressure cell 640 are communicated with each other.

Since the valve 620 has the gimbal structure, the diaphragm 621 is moved inside the through-part 630 with being maintained parallel to the face of the main body 64 in which the second static pressure cell 640 is formed, and thereby assuredly closing the opening part of the second static pressure cell 640.

Here, the spacer plate 63 regulates stroke of the diaphragm 621 for a case where the communication flow path 600 is transited from the first state to the second state by using the thickness thereof. In order to assuredly shifting the state of the communication flow path 600 to the second state, the stroke needs to be regulated for each diaphragm 621 with high precision. Accordingly, it is preferable that a configuration using a plate member is used as this embodiment.

As a structure other than that using the spacer plate 63, the spacer plate may be formed integrally with the main body 64. However, in such a case, it is difficult to regulate the strokes of the diaphragms 621 to be uniform, compared to this embodiment.

The size of the through-hole 625, the suction force of the fan 50, the size of the suction hole 42, the capacity of the first static pressure cell 611, the size of the through-part 630, the capacity of the second static pressure cell 640, and the like are appropriately designed such that the opening part of the second static pressure cell 640 is closed against the spring forces of the first and second arms 623 and 624 in a case where the suction hole 42 is not covered with the recording medium S.

When the size of the through-hole 625 is set to be large, much gas is sucked from the suction hole 42 through the through-hole 625 in a case where the suction hole 42 is not covered with the recording medium S (a case where the communication flow path 600 is in the second state). Accordingly, in such a case, the loss of a negative pressure generated by the fan 50 increases. On the other hand, when the size of the through-hole 625 is set to be small, it takes time for the pressure of the first static pressure cell 611 to be changed in accordance with existence of a recording medium S that covers the suction hole 42. Accordingly, in such a case, the responsiveness of the diaphragm 621 is decreased. Thus, it is preferable that the size of the through-hole 625 is appropriately set in consideration of such situations.

In addition, as the volumes of the first static pressure cell 611 and the groove 610 decrease, a change of the pressure of the first static pressure cell 611 is quickly generated in accordance with the existence of a recording medium S that covers the suction hole 42, and accordingly, the responsiveness of the diaphragm 621 is improved.

As the flow path shifting unit 70, other than a unit using the diaphragm 621, a unit in which covering of the suction holes 42 with the recording medium S is detected by using a sensor or the like and suction holes are selected by driving small fans disposed for each suction hole 42 may be used. In addition, covering of the suction holes 42 with the recording medium S may be detected by a sensor or the like, and suction holes 42 may be selected by using a shutter and a shutter driving device or an electronic diaphragm.

According to this embodiment, there are the following advantages.

The cross-section area of the flow path of the communication flow path 600 that is communicated with suction holes 42 not covered with the recording medium S is smaller than that of the communication flow path 600 that is communicated with suction holes 42 covered with the recording medium S. In other words, the flow path switching unit 70 can appropriately select the cross-section area of the flow path in accordance with existence of a recording medium S that covers the suction holes 42. Accordingly, the flow of gas in the suction holes 42 not covered with the recording medium S can be relatively small. Thus, a stable suction force can be acquired regardless of the size and tilt of the recording medium S to be adsorbed. In addition, since noise and variances of load for suction due to the flow of air are small, the sheet adsorption device 30, the transport device 20, and the image forming apparatus 100 that have decreased power consumption can be acquired.

When the suction hole 42 is not covered with the recording medium S, the pressure inside the first static pressure cell 611, which is close to the atmospheric pressure, becomes higher than that inside the second static pressure cell 640. In such a case, since the cross-section area of the flow path of gas between the first static pressure cell 611 and the second static pressure cell 640 is decreased due to the valve 620 that partially opens or closes the communication flow path 600, the flow of gas flowing from the suction hole 42 can be decreased. Accordingly, suction holes 42 covered with the recording medium S mainly sucks gas, and a stable suction force can be acquired regardless of the size and tilt of the recording medium S to be adsorbed. In addition, since noise and variances of load for suction due to the flow of air are small, the sheet adsorption device 30, the transport device 20, and the image forming apparatus 100 that have decreased power consumption can be acquired.

In a state that the suction hole 42 is covered with the recording medium S, the communication flow path 600 is not closed. Accordingly, the pressure of the first static pressure cell 611 is changed in accordance with existence of the recording medium S that covers the suction hole 42, and thereby the position of the diaphragm 621 can be appropriately changed.

Since the valve 620 opens or closes the slits 626 and 627 that are a part of the first flow path part, the communication flow path 600 is communicated with the through-hole 625 that is a part of the second flow path part. Accordingly, even when the valve 620 is closed, the pressure of the valve 620 inside the communication flow path 600 on both sides can be easily controlled through the through-hole 625.

Since the valve 620 partially opens the communication flow path 600 of the first static pressure cell 611 and the second static pressure cell 640 by using the diaphragm 621, the flow path shifting unit 70 can be configured as a simple structure. Accordingly, the flow path shifting unit 70 is decreased in size and thickness, and thereby the sheet adsorption device 30, the transport device 20, and the image forming apparatus 100 that are decreased in size and thickness can be acquired.

Since the flow path shifting unit 70 is configured as a simple structure in which the belt receiving plate 61 having the first static pressure cell 611 formed therein and the main body 64 having the belt plate 62, the spacer plate 63, and the second static pressure cell 640 formed therein are laminated, supply of power from the outside is not needed. Accordingly, the sheet adsorption device 30, the transport device 20, and the image forming apparatus 100 that have decreased power consumption can be acquired. In addition, since the flow path shifting unit 70 is configured as a laminated structure, the flow path shifting unit 70 can be decreased in size and thickness, and thereby the sheet adsorption device 30, the transport device 20, and the image forming apparatus 100 that are decreased in size and thickness can be acquired.

The valve 620 has so-called a gimbal structure. Accordingly, when the diaphragm 621 is moved inside the through-part 630 as a valve casing, inclination of the diaphragm 621 with respect to the flow of gas can be decreased. Accordingly, the flow of gas is controlled to be reproduced well by the diaphragm 621, and thereby the sheet adsorption device 30, the transport device 20, and the image forming apparatus 100 that can correctly select suction holes 42 that are covered with the recording medium S can be acquired.

Since the flow path shifting unit is formed by laminating the spacer plate 63 in which the through-part 630 is formed, the precision of the shape is improved, compared to a case where it is formed by processing a base member as a valve casing, and thereby the cost can be decreased.

In suction holes 42 that are not covered with the recording medium S, suction is suppressed, and accordingly, the flow of air near an outer edge of the recording medium S can be suppressed. Thereby, an image forming apparatus 100 in which winding of flight of ink 11 ejected from the liquid ejecting head 10 is suppressed can be acquired.

When the suction hole is covered with the recording medium S, it is preferable that insides of the first static pressure cell 611 and the second static pressure cell 640 have negative pressure. Accordingly, not only an airflow-type fan but also a piston-type pump can be used.

The position at which the diaphragm 621 is stopped and the responsiveness of the diaphragm 621 can be determined by changing the size of the through-hole 625, the width of the support part 622, and the sizes of the slits 626 and 627.

When the fan 50 is driven, in the belt 40, suction from suction holes 42 that are not covered with the recording medium S is suppressed and a strong suction force is applied to suction holes 42 that are covered with the recording medium S. Accordingly, when positioning and transporting the recording medium S, the belt 40 can apply an appropriate suction force to the front and rear ends of the recording medium S in the transport direction even in a case where a plurality of suction holes 42 are communicated with the fan 50. In other words, to the whole recording medium S from the front end in the transport direction to the rear end which is positioned and transported by the belt 40, an appropriate suction force can be applied, and the recording medium S can be transported with being stably supported by the surface of the belt 40. In addition, even when a recording medium S that has the size in the width direction perpendicular to the transport direction different from other recording media S or a recording medium S that has a width changing in the middle of one sheet of the recording medium S is used, the cross-section area of the communication flow path is changed in accordance with existence of the recording medium S on the suction hole 42. Accordingly, by applying a strong suction force only to suction holes 42 that are covered with the recording medium S, the recording medium can be stably transported with the whole face including the end part of the recording medium S adsorbed.

Second Embodiment

Figure 9:
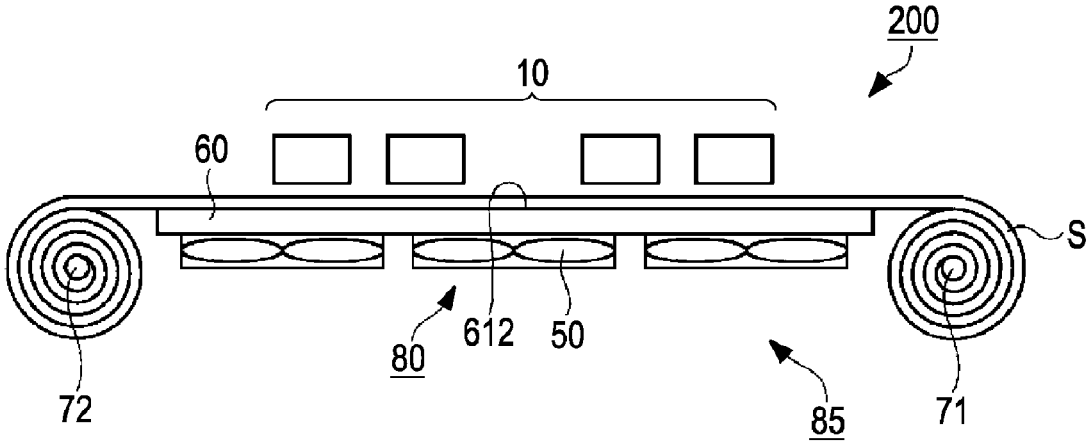
FIG. 9 is a schematic cross-section view of an image forming apparatus according to a second embodiment of the invention.

FIG. 9 is a schematic cross-section view of an image forming apparatus 200 according to a second embodiment of the invention. The image forming apparatus 200 according to this embodiment continuously prints on a recording medium S that is roll paper. A major difference of the second embodiment from the first embodiment is that the belt 40 is not included in a transport device 85.

As shown in FIG. 9, the transport device 85 includes a paper transport roller 71, a paper winding roller 72, and a sheet adsorption device 80.

A recording medium S is transported from the paper transport roller 71 to the paper winding roller 72 while being adsorbed to a sheet adsorbing surface 612.

The sheet adsorption device 80 includes a fan 50 as a suction unit and a static pressure control unit 60.

In this embodiment, the sheet adsorbing surface 612 of the sheet adsorption device 80 is a face in which the groove 610 of the belt receiving plate 61 according to the first embodiment, shown in FIGS. 5, 7, and 8, is disposed. Accordingly, the recording medium S is directly adsorbed to the face in which the groove 610 is disposed.

In addition, according to this embodiment, a hole formed in the first static pressure cell 611, instead of the suction hole 42 formed in the belt 40 according to the first embodiment, shown in FIGS. 5 and 7, acts also as the suction hole 613.

In this embodiment, the groove 610 shown in FIGS. 5, 7, and 8 may not be provided. In such a case, the recording medium S directly covers the suction hole 613.

According to this embodiment, the following advantage can be acquired.

Even for a large-size image forming apparatus 200 that uses roll paper, the same advantages as those of the first embodiment can be acquired.

The present invention is not limited to the above-described embodiments, and various changes from the above descriptions can be made therein without departing from the gist of the invention.

Third Embodiment

Figure 10:
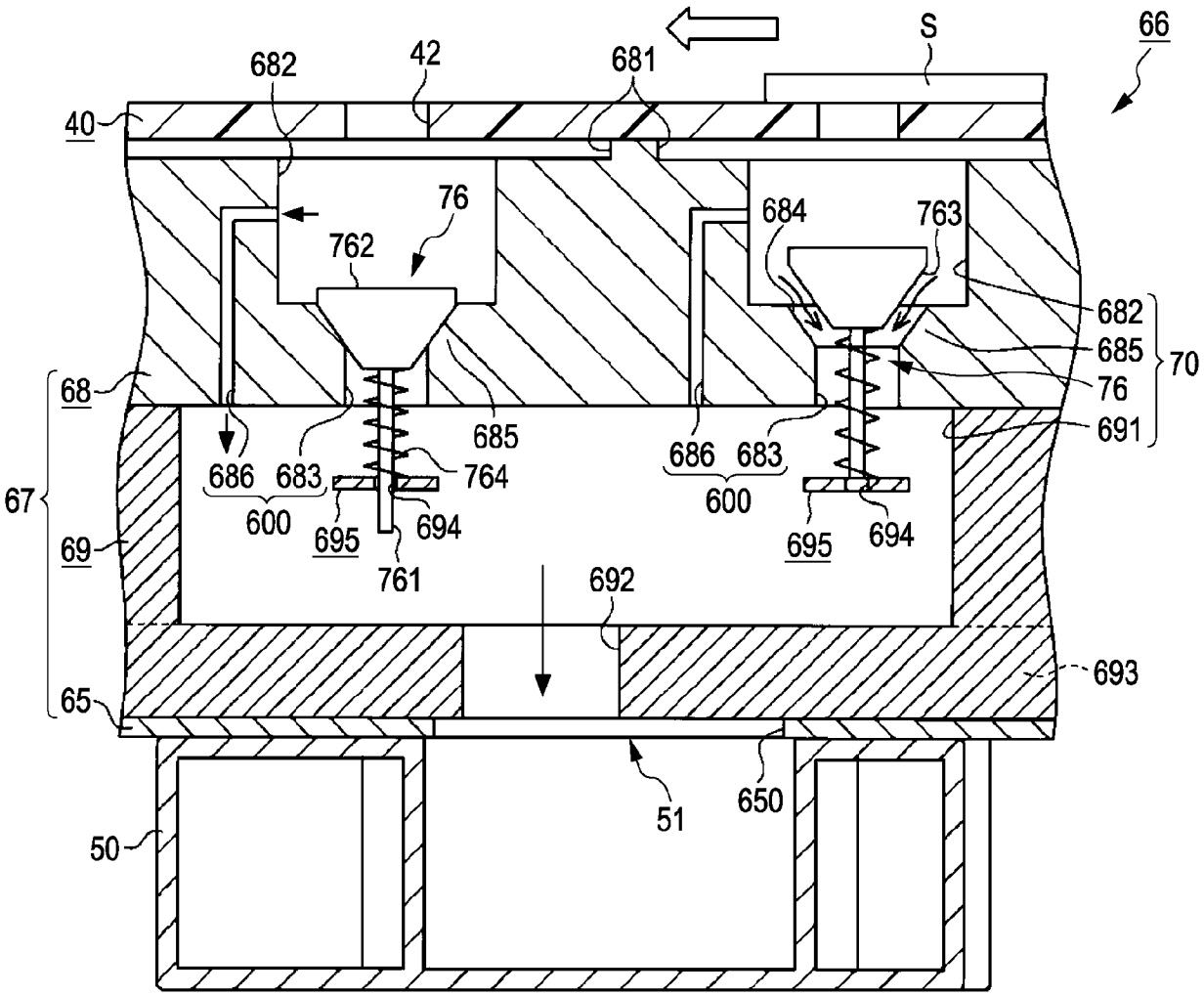
FIG. 10 is a schematic cross-section view of a static pressure control unit according to a third embodiment of the invention.

FIG. 10 is a schematic cross-section view of a sheet adsorption device 66 included in an image forming apparatus according to a third embodiment of the invention. In the figure, arrows denote a flow path of gas in a case where the gas is sucked by a fan 50. In addition, an outline arrow represents the transport direction of a recording medium S. In this embodiment, the configuration except for a sheet adsorption device 66 is the same as that of the first embodiment. In particular, a static pressure control unit 67 disposed between a belt 40 and a fan 50 of the sheet adsorption device 66 shifts the state of a communication flow path 600 between a first state and a second state for controlling suction states of each suction hole 42.

As shown in FIG. 10, the sheet adsorption device 66 includes a belt receiving plate 68 as a first plate-shaped member that can support a recording medium S positioned on the belt 40 up to a position over the belt 40, a main body 69 as a second plate-shaped member, and a sealing plate 65. The belt receiving plate 68, the main body 69, and the sealing plate 65 are laminated in the mentioned order from the belt 40 side located on the upper side toward the fan 50 side located on the lower side.

On the upper face of the belt receiving plate 68, similarly to the belt receiving plate 61 according to the first embodiment, a plurality of grooves 681 is formed in a zigzag pattern along the row of suction holes 42 in the transport direction of the recording medium S. Each grove 681 is formed to be thin and long in the transport direction of the recording medium S. The length of each groove 681 in the transport direction of the recording medium S is formed to be equivalent to the pitch of two suction holes 42 that are aligned in the row of the transport direction of the recording medium S such that one of the suction holes 42 is fitted into the groove 681 even in a case where the suction holes 42 are moved in accordance with movement of the belt 40.

In addition, on the bottom of the groove 681 of the belt receiving plate 68, a first static pressure cell 682 having an approximate cylinder shape is disposed to be concaved, and on the bottom of the first static pressure cell 682, a through-hole 683 that perforates the lower face of the belt receiving plate 68 is formed. In addition, an edge part of an opening of the through-hole 683 located on the upper side, which becomes the first static pressure cell 682 side, is cut off to be formed as a valve seat 685 having a contact surface 684 in the shape of a conic surface of which upper side is increased in diameter.

In addition, on the lower face of the belt receiving plate 68, a communication hole 686 as a communicating part that extends toward the upper side in parallel with an axis line of the through-hole 683 from a position near the through-hole 683 and then is bent in the horizontal direction to be opened for the inner face of the first static pressure cell 682 is formed.

The communication hole 686 is formed to have a diameter smaller (that is, having a smaller cross-section area of the flow path) than that of the through-hole 683, in the edge part of the upper opening of which the valve seat 685 is formed. In addition, in this embodiment, a first flow path part of the communication flow path 600 is configured by the through-hole 683 having a larger diameter, and a second flow path part of the communication flow path 600 is configured by the through-hole 686 having a smaller diameter.

In addition, on the upper face of the main body 69, a second static pressure cell 691 having an approximate cylinder shape is disposed to be concaved so as to be fitted into two of the first static pressure cells 682 in the transport direction of the recording medium S. The two of the first static pressure cells 682 are communicated with the inside of the second static pressure cell 691 through the through-hole 683 and the communication hole 686 of which one ends are opened to the inside of each first static pressure cell 682. In addition, the second static pressure cell 691 is formed to have a volume larger than the first static pressure cell 682, and on the bottom of the second static pressure cell 691, a through-hole 692 that perforates the lower face of the main body 69 is formed. In the main body 69, a plurality of the second static pressure cells 691 is formed, and the second static pressure cells 691 are communicated with one another through a flow path 693 that is communicated with each through-hole 692.

The sealing plate 65 has a same configuration as the sealing plate 65 of the first embodiment. In the sealing plate 65, a hole 650 is formed along the suction opening 51 of the fan 50. The suction opening 51 is communicated with the flow path 693 of the main body 69 through this hole 650, and accordingly, the fan 50 is communicated with each second static pressure cell 691.

In addition, inside the second static pressure cell 691 of the main body 69, support plates 695 each having a support hole 694 so as to face the through-holes 683 of the first static pressure cells 682 are formed integrally with the main body 69. The lower end side of a rod member 761 having a cylinder shape that constitutes a valve 76 is inserted into this support hole 694 to be slidable. The upper end of the rod member 761 is positioned inside the first static pressure cell 682. In addition, in the upper end of the rod member 761, a valve body 762 that has an approximate circular truncated cone shape and can be brought into face contact with the contact surface 684 of the valve seat 685 is formed integrally with the rod member 761. As the contact surface 763 of the valve body 762 which forms a conic surface shape is brought into contact with the contact surface 684 of the valve seat 685, the first flow path part of the communication flow path 600 is closed.

Between the support plate 695 and the valve body 762, a spring 764 as a biasing member is interposed. Depending on the biasing force of the spring 764, the valve body 762 of the valve 76 is biased in the direction for enlarging the cross-section area of the flow path of the communication flow path 600. In other words, commonly, the valve 76 is in an open state (a first valve state) in which the valve body 762 is separated from the valve seat 685. Here, the biasing force of the spring 764 is smaller than a differential pressure between the first static pressure cell 682 that is not covered with the recording medium S to be in an atmospheric pressure state and the second static pressure cell 691 that is sucked by the fan 50. In addition, the biasing force of the spring 764 has strength for separating the valve body 762 from the valve seat 685 in a case where the pressures of the first static pressure cell 682 and the second static pressure cell 691 has the same pressure. In this embodiment, a flow path shifting unit 70 that is shifted between the first state and the second state of the communication flow path 600 is configured by the first static pressure cell 682, the second static pressure cell 691, the valve 76, and the valve seat 685.

Hereinafter, movement of the valve 76 of the flow path shifting unit 70 and the first and second states of the communication flow path 600 will be described in detail.

The valve bodies 762 of two valves 76 positioned on the right and left sides in FIG. 10 are commonly biased in the direction for being separated from the valve seat 685 by the biasing force of the spring 764, and the valves are in an open state (the first valve state) in which the through-hole 683 as the first flow path part is opened. Then, when the fan 50 is driven in the state, the pressure inside the second static pressure cell 691 becomes a negative pressure due to the suction force of the fan 50. Thus, the differential pressure between the pressure inside the second static pressure cell 691 and the pressure inside first static pressure cell 682 exceeds the biasing force of the spring 764. Accordingly, the valve body 762 of the valve 76 is moved in a direction for being seated on the valve seat 685 in resistance to the biasing force of the spring 764, and the valve 76 is in a closed state (a second valve state) in which the through-hole 683 as the first flow path part is closed (see the left valve 76 shown in FIG. 10), and accordingly, the communication flow path 600 is in the second state.

Next, in this state, when a suction hole 42, which is covered with the recording medium S, among the suction holes 42 of the belt 40 that positions and transports the recording medium S is located in a position corresponding to the first static pressure cell 682 in accordance with movement of the belt 40, flow of gas inside the first static pressure cell 682 from the outside through the suction hole 42 is suppressed. Then, gas is gradually flowed inside the second static pressure cell 691 from the inside of the first static pressure cell 682 through the communication hole 686 as the second flow path part, and the differential pressure between the first and second static pressure cells 682 and 691 decreases gradually and finally becomes weaker than the biasing force of the spring 764. Then, the valve body 762 of the valve 76 is moved in a direction for being separated from the valve seat 685 by the biasing force of the spring 764, and the valve 76 is in the open state (the first valve state) in which the through-hole 683 as the first flow path part is open (see the right valve 76 in FIG. 10), and thereby transiting the communication flow path 600 from the second state to the first state.

Then, from this state, when a suction hole 42, which is not covered with the recording medium S, among the suction holes 42 of the belt 40 that positions and transports the recording medium S is located in a position corresponding to the first static pressure cell 682 in accordance with movement of the belt 40, gas is flowed into the first static pressure cell 682 from the outside through the suction hole 42. Then, the pressure inside the first static pressure cell 682 becomes a pressure close to the atmospheric pressure, and thus the differential pressure between the pressure of the first static pressure cell 682 and the pressure of the second static pressure cell 691 which is a negative pressure exceeds the biasing force of the spring 764. Then, the valve body 762 of the valve 76 is moved in a direction for being seated on the valve seat 685 in resistance to the biasing force of the spring 764. Accordingly, the valve is in the closed state (the second valve state) in which the through-hole 683 as the first flow path part is closed (see the left valve 76 in FIG. 10), and thereby transiting the communication flow path 600 from the first state to the second state.

According to this embodiment, the following advantage can be acquired.

Even when the valve body 762 that is formed to seat the valve 76 on the valve seat 685 and the spring 764 that is commonly configured to bias the valve body 762 in the direction for being separated from the valve seat 685 are included instead of the diaphragm, the same advantages of those of the first and second embodiments can be acquired. Accordingly, the flow path shifting unit 70 is configured as a simple structure.

In addition, a configuration in which a valve plate formed of spring steel and a main body 69 formed of a material other than spring steel are laminated to be sealed is not used for the second static pressure cell 691 that becomes a negative pressure chamber in a case where the fan 50 is driven for a suction operation. Accordingly, for example, even when a heating unit (for example, a heater or a warm air-type furnace) is included for accelerating to dry ink ejected onto the recording medium S, deformation due to heat transfer is not generated, differently from a case where a valve plate having a coefficient of thermal expansion different from that of the main body 69 is laminated in the main body 69 for sealing the second static pressure cell 691. Accordingly, the range of choice for a material that forms the belt receiving plate 68 and the main body 69 that configure the static pressure control unit 67 can be widened.

Regarding volumes of the first static pressure cell 682 and the second static pressure cell 691, the volume of the second static pressure cell 691 as a first negative pressure chamber that first comes to have negative pressure in accordance with the drive of the fan 50 is configured to be larger than that of the first static pressure cell 682 as a second negative pressure chamber that comes to have negative pressure thereafter. Accordingly, a strong suction force can be applied to a recoding medium S in a case when the communication flow path 600 transits from the second state to the first state. Accordingly, the front end of the recording medium S in the transport direction can be appropriately adsorbed.

Modified Example 1

Figure 11:
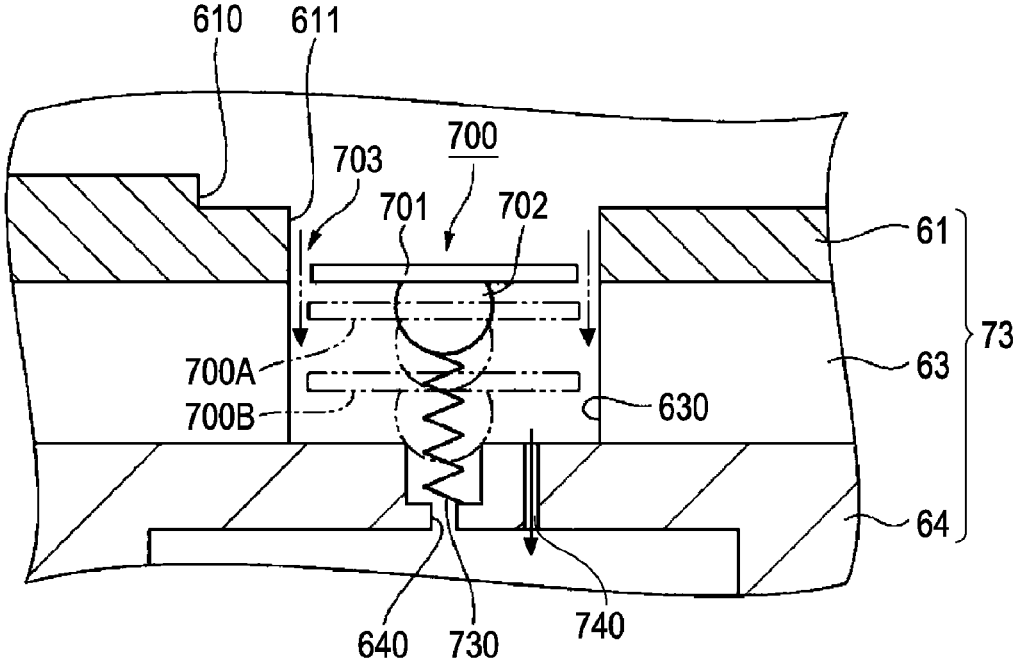
FIG. 11 is an enlarged cross-section view around a flow path shifting unit according to Modified Example 1.

FIG. 11 is an enlarged cross-section view around a flow path shifting unit 73 according to Modified Example 1.

The configuration except for the flow path shifting unit 73 is the same as that of the first embodiment. In particular, a moving part 700 and a spring 730 are used instead of the diaphragm 621 for shifting between the first and second states of the communication flow path 600 shown in FIG. 7.

As shown in FIG. 11, the flow path shifting unit 73 includes a first static pressure cell 611, the moving part 700, the spring 730, a through-part 630, a second static pressure cell 640, a first static pressure cell 611, and a through-hole 740 that communicates the through-part 630 and the second static pressure cell 640.

The moving part 700 includes a divider plate 701 and a sphere body part 702 and is supported by a spring 730. Between the divider plate 701 and the inner walls of the first static pressure cell 611 and the through-part 630, a gap 703 is formed.

Hereinafter, movement of the moving part 700 of the flow path shifting unit 73 and the first and second states of the communication flow path 600 will be described in detail.

In FIG. 11, arrows represent a flow path of gas in a case where the gas is sucked by the fan 50.

In FIG. 11, the gap 703 configures a first flow path part, and the through-hole 740 configures a second flow path part.

A solid arrow represents the flow of gas through the second flow path part, and dashed-two dotted arrows represent the flow of gas through the first flow path part.

In FIG. 11, when a suction hole 42 of the belt 40 is covered with the recording medium S, there is a little flow of gas from the suction hole 42. In addition, the first static pressure cell 611 and the second static pressure cell 640 are communicated with each other through the through-hole 740 and the gap 703. In such a case, since pressure compensation due to inflow of gas from the suction hole 42 is small, there is not a large difference between the pressure inside the first static pressure cell 611 and the pressure inside the second static pressure cell 640. Accordingly, a force due to the flow of gas is not applied much to the moving part 700.

The moving part 700 is stopped at a position 700A denoted by a dashed two-dotted line in which a suction force of the fan 50, a force applied to the moving part 700, and a restoring force due to the spring force of the spring 730 are balanced.

The gas flows through the first flow path part and the second flow path part. This state is the first state of the communication flow path 600.

When the suction hole 42 of the belt 40 is not covered with the recording medium S, the pressure inside the first static pressure cell 611 is close to the atmospheric pressure. In addition, the pressure inside the second static pressure cell 640 that is sucked by the fan 50 is a negative pressure. Accordingly, the gas flows so as to press the divider plate 701 of the moving part 700 in the direction of the second static pressure cell 640.

The moving part 700 is moved inside the through-part 630 against the spring force of the spring 730, and the sphere body part 702 blocks the opening part of the second static pressure cell 640 at a position 700B denoted by dashed two-dotted line.

The gas flows through the second flow path part. This state is the second state of the communication flow path 600.

Modified Example 2

Figure 12:
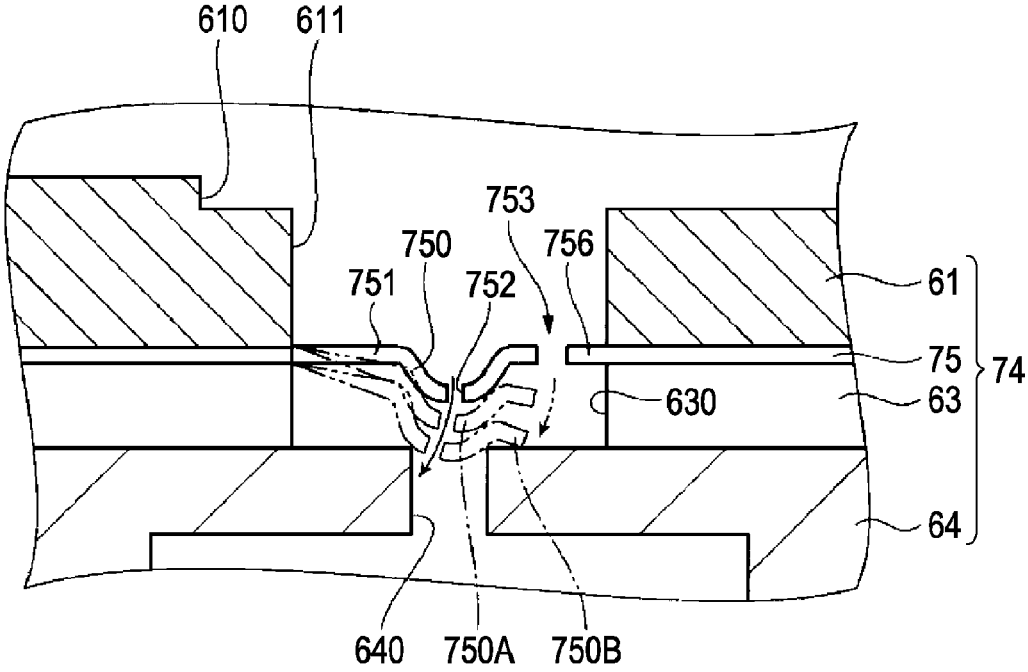
FIG. 12 is an enlarged cross-section view around a flow path shifting unit according to Modified Example 2.

FIG. 12 is an enlarged cross-section view around a flow path shifting unit 74 according to Modified Example 2. In particular, the shape of a diaphragm 750 is different from that of the above-described diaphragm.

The configuration except for the flow path shifting unit 74 is the same as that of the first embodiment.

In FIG. 12, the diaphragm 750 has a hemispherical enclosure shape and is fixed to a valve plate 75 on one side by an arm 751. In the diaphragm 750, a through-hole 752 is formed.

Hereinafter, movement of the diaphragm 750 of the flow path shifting unit 74 and the first and second states of the communication flow path 600 shown in FIG. 7 will be described in detail.

In FIG. 12, arrows represent a flow path of gas in a case where the gas is sucked by the fan 50.

In FIG. 12, a slit 753 on one side of the diaphragm 750 which is not cantilevered configures the first flow path part, and the through-hole 752 configures the second flow path part.

A solid arrow represents the flow of gas through the second flow path part, and dashed-two dotted arrows represent the flow of gas through the first flow path part.

In FIG. 12, when a suction hole 42 of the belt 40 is covered with the recording medium S, there is a little flow of gas from the suction hole 42. In addition, the first static pressure cell 611 and the second static pressure cell 640 are communicated with each other through the through-hole 752 and the slit 753. In such a case, since pressure compensation due to inflow of gas from the suction hole 42 is small, there is not a large difference between the pressure inside the first static pressure cell 611 and the pressure inside the second static pressure cell 640. Accordingly, a force due to the flow of gas is not applied much to the diaphragm 750.

The diaphragm 750 is stopped at a position 750A denoted by a dashed two-dotted line in which a suction force of the fan 50, a force applied to the diaphragm 750, and a restoring force due to the spring force of the arm 751 are balanced.

The gas flows through the first flow path part and the second flow path part. This state is the first state of the communication flow path 600.

The stop position is determined in accordance with sizes of the through-hole 752 and the slit 753.

When the suction hole 42 of the belt 40 is not covered with the recording medium S, the pressure inside the first static pressure cell 611 is close to the atmospheric pressure. In addition, the pressure inside the second static pressure cell 640 that is sucked by the fan 50 is negative pressure. Accordingly, the gas flows so as to press the diaphragm 750 in the direction of the second static pressure cell 640.

The diaphragm 750 is moved inside the through-part 630 against the spring force of the arm 751, and blocks the opening part of the second static pressure cell 640 at a position 750B denoted by a dashed two-dotted line.

The gas flows through the second flow path part. This state is the second state of the communication flow path 600.

By using a pull-out part 756 of the valve plate 75 located in a position for facing the diaphragm 750, the width of the slit 753 can be determined. The pull-out part 756 may not be included.

Modified Example 3

Figure 13A:
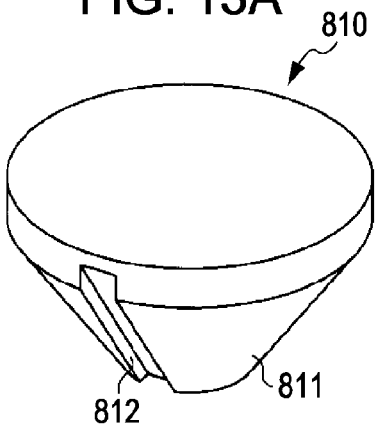
FIG. 13A is a perspective view of a valve body according to Modified Example 3, viewed from the upper side.
Figure 13B:
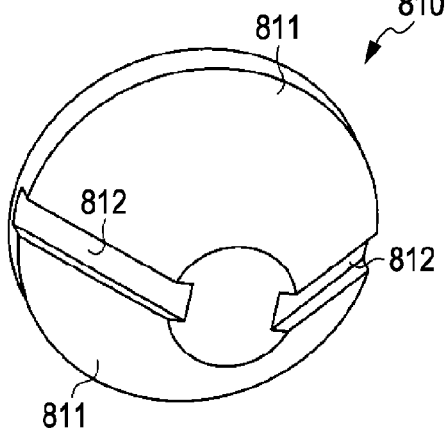
FIG. 13B is a perspective view of the valve body, viewed from the lower side.

FIGS. 13A and 13B are perspective views of a valve body 810 according to Modified Example 3.

The configuration except for a valve body 810 is the same as that of the third embodiment. In particular, a communicating part that becomes the second flow path part which communicates the first static pressure cell 682 and the second static pressure cell 691 in a case where a contact surface 811 of the valve body 810 and a contact surface 684 of the valve seat 685 are brought into contract with each other by a concave part 812 formed on the contact surface 811 of the valve body 810 which has a conic surface shape is formed.

Accordingly, in the first state of the communication flow path 600 in which the valve body 810 is separated from the valve seat 685, similarly to the third embodiment, a gap between the valve body 810 and the valve seat 685 and the through-hole 683 become the first flow path part, and accordingly, a suction force is applied to the recording medium S. On the other hand, in the second state of the communication flow path 600 in which the valve body 810 is seated on the valve seat 685, the contact surface 811 of the valve body 810 is brought into contact with the contact surface 684 of the valve seat 685, and the second flow path part is formed by a gap between the concave part 812 and the contact surface 684 of the valve seat 685.

Accordingly, the second flow path part can be formed as a simple configuration without forming a communication hole 686 in the main body 69. In addition, two second flow path parts are formed by two concave parts 812. Accordingly, even when one concave part 812 is clogged by paper dusts or dried ink, a negative pressure can be delivered to the first static pressure cell 682 that is in the first state by using the other concave part 812.

Modified Example 4

Figure 14A:
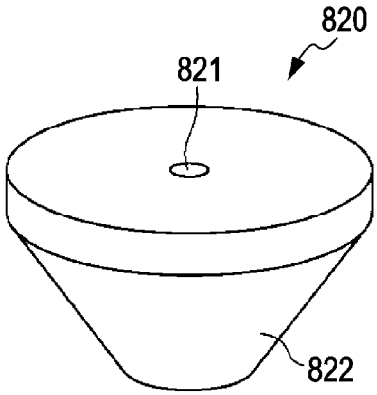
FIG. 14A is a perspective view of a valve body according to Modified Example 4, viewed from the upper side.
Figure 14B:
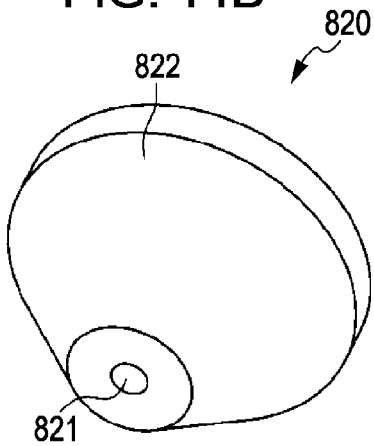
FIG. 14B is a perspective view of the valve body, viewed from the lower side.

FIGS. 14A and 14B are perspective views of a valve body 820 according to Modified Example 4.

The configuration except for the valve body 820 is the same as that of the third embodiment. In particular, a through-hole 821 is formed in a center part of the valve body 820 in the direction of an axis line, and a communicating part that becomes a second flow path part that communicates a first static pressure cell 682 and a second static pressure cell 691 in a case where a contact surface 822 of the valve body 820 and a contact surface 684 of a valve seat 685 are brought into contact with each other.

Accordingly, in a first state of a communication flow path 600 in which the valve body 820 is separated from the valve seat 685, similarly to the third embodiment, a gap between the valve body 820 and the valve seat 685 and a through-hole 683 become a first flow path part, and accordingly, a suction force is applied to the recording medium S. On the other hand, in a second state of the communication flow path 600 in which the valve body 820 is seated on the valve seat 685, a second flow path part is formed by a through-hole 821 that is formed in a center part of the valve body 820.

Accordingly, the second flow path part can be formed by the through-hole 821 that is formed in the center part of the valve body 820 as a simple configuration.

Modified Example 5

Figure 15A:
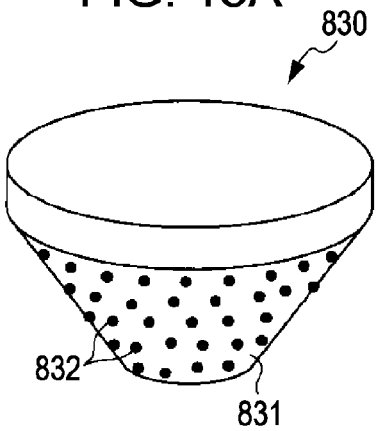
FIG. 15A is a perspective view of a valve body according to Modified Example 5, viewed from the upper side.
Figure 15B:
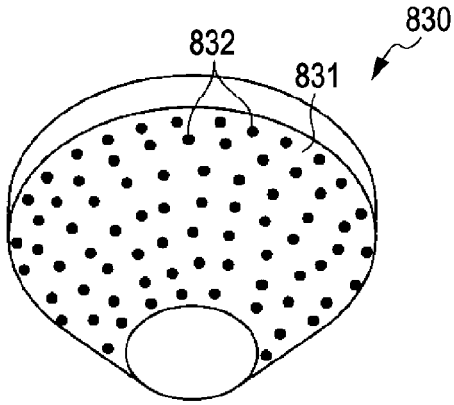
FIG. 15B is a perspective view of the valve body, viewed from the lower side.

FIGS. 15A and 15B are perspective views of a valve body 830 according to Modified Example 5.

The configuration except for the valve body 830 is the same as that of the third embodiment. In particular, a communicating part that becomes a second flow path part that is communicated with a first static pressure cell 682 and a second static pressure cell 691 in a case where the valve body 830 is seated on a valve seat 685 by forming a plurality of convex parts 832 on the entire contact surface 831 of the valve body 830 instead of the communication hole 686.

Accordingly, in a first state of a communication flow path 600 in which the valve body 830 is separated from the valve seat 685, similarly to the third embodiment, a gap between the valve body 830 and the valve seat 685 and a through-hole 683 become a first flow path part, and accordingly, a suction force is applied to the recording medium S. On the other hand, in a second state of the communication flow path 600 in which the valve body 830 is seated on the valve seat 685, the convex parts 832 of the valve body 830 are brought into contact with a contact surface 684 of the valve seat 685, and a second flow path part is formed by a gap between the contact surface 831 of the valve body 830 and a contact surface 684 of the valve seat 685.

Accordingly, a plurality of the second flow path parts is formed between the contact surface 831 of the valve body 830 and the contact surface 684 of the valve seat 685 by the plurality of the convex parts 832. Thus, even when a gap between adjacent convex parts 832 is clogged by paper dusts or dried ink, a second flow path part is acquired by gaps of other plural convex parts 832.

Besides the above-described modified examples, various changes can be made.

For example, a valve casing may be formed in the main body 64 that is the second plate-shaped member, instead of disposing the spacer plate 63 that is the fourth plate-shaped member.

In addition, the number, shape, size, and disposition of the suction holes 42 and 613 and the shape, size, and disposition of the groove 610 may be appropriately selected in accordance with a recording medium S to be handled.

In addition, materials of the valve 620 and the diaphragm 621, the size and shape of the through-hole 625 formed in the diaphragm 621, the shapes of the support part 622 and the arms 623 and 624, and the like may be selected such that the diaphragm 621 can open or close the opening part of the second static pressure cell 640 depending on whether the suction holes 42 and 613 are covered with the recording medium S.

In particular, appropriate sizes, shapes, materials, and the like of the valve 620, the diaphragm 621 and the like are selected in accordance with the suction force of the fan 50, the shape and size of the suction hole 42, the shapes and sizes of the first static pressure cell 611 and the suction hole 613, the shape and size of the communicating part 630, and the shapes and sizes of the second static pressure cell 640 and the static pressure cell 642.

In addition, a convex part and a concave part may be formed in the valve seat 685 on which the valve body is seated, and the convex part and the concave part may be formed on both the valve body and the valve seat 685. In such a case, the concave part on one side is not needed to be open to both sides of the first static pressure cell 682 and the second static pressure cell 691. Thus, the concave part may be formed such that the first static pressure cell 682 and the second static pressure cell 691 are communicated with each other by the concave parts on both sides which are formed in the valve body and the valve seat 685.

In addition, by forming the valve body with a material through which gas can pass and which has high flow path resistance (for example, a porous member such as a sintered body), the flow path of gas passing though the inside of the valve body may be configured as the second flow path part.

In addition, although the invention is applied to a color image forming apparatus in each of the above-described embodiments, the application object is not limited thereto. Thus, the invention may be applied to a monochrome image forming apparatus that forms a monochrome image.

In addition, the sheet adsorption devices 30 and 80, the transport devices 20 and 85 of the above-described embodiments are not used only in the image forming apparatuses 100 and 200. For example, the above-described devices may be used for transporting a substrate in a manufacturing process of an X-Y recorder, a bulletin panel, a wall of a house, a dashboard of a vehicle for fixing a sheet.

What is claimed is:

1. A sheet adsorption device comprising:

a sheet adsorbing surface;

a suction hole disposed on the sheet adsorbing surface; and a negative pressure generating unit that applies a suction force on the sheet;

a communication flow path that extends from the suction hole to the negative pressure generating unit;

a flow path shifting unit that shifts between a first state and a second state of the communication flow path in accordance with existence of a sheet that covers the suction hole, wherein a suction force of the suction hole in the second state is smaller than that in the first state and wherein the communication flow path is not closed in the second state;

wherein the communication flow path includes a first flow path part that is opened and shut by a valve and a second flow path part that is always open between the suction hole and the negative pressure generating unit, wherein the valve is disposed between the suction hole and the negative pressure generating unit and wherein the valve opens and shuts according to a difference in pressure between the communication flow path on a suction hole side of the valve and the communication flow path on a negative pressure generating unit side of the valve, wherein the second flow path part comprises a portion of the valve and a contact surface of the communication flow path which comes into contact with the valve when the valve shuts, wherein the valve comprises a plate-shaped member and is supported on both sides in a direction that is approximately perpendicular to at least one direction by a support part that is supported on both sides in at least the one direction by a base body of the plate-shaped member, and wherein the second flow path part is a through hole configured to the plate-shaped member forming the valve.

2. The sheet adsorption device according to claim 1, wherein the valve has a valve body, and wherein the valve body is commonly biased in a direction in which the communication flow path is in the first state by a biasing force of a biasing member, and is displaced in a direction in which the communication flow path is the second state in resistance to the biasing force in a case where a difference in pressure between the communication flow path on a suction hole side of the valve and the communication flow path on a negative pressure generating unit side of the valve.

3. The sheet adsorption device according to claim 1, wherein the second flow path part comprises a second path formed separately than the first flow path which flows through the valve disposed between the communication flow path on the suction hole side against the valve and the communication flow path on the negative pressure generating unit side against the valve.

4. A transport device that transports a sheet by adsorbing the sheet to a sheet adsorbing surface, the transport device comprising:

a moving part of the sheet adsorbing surface; and the sheet adsorption device according to claim 1.

5. An image forming apparatus that forms an image on a sheet, the image forming apparatus comprising transport device according to claim 4.

6. An image forming apparatus that forms an image on a sheet, the image forming apparatus comprising the sheet adsorption device according to claim 1.

7. A sheet adsorption device comprising:

a sheet adsorbing surface;

a suction hole disposed on the sheet adsorbing surface; and a negative pressure generating unit that applies a suction force on the sheet;

a communication flow path that extends from the suction hole to the negative pressure generating unit;

a flow path shifting unit that shifts between a first state and a second state of the communication flow path in accordance with existence of a sheet that covers the suction hole, wherein a suction force of the suction hole in the second state is smaller than that in the first state and wherein the communication flow path is not closed in the second state;

wherein the communication flow path includes a first flow path part that is opened and shut by a valve and a second flow path part that is always open between the suction hole and the negative pressure generating unit, wherein the valve is disposed between the suction hole and the negative pressure generating unit and wherein the valve opens and shuts according to a difference in pressure between the communication flow path on a suction hole side of the valve and the communication flow path on a negative pressure generating unit side of the valve, wherein the second flow path part comprises a portion of the valve and a contact surface of the communication flow path which comes into contact with the valve when the valve shuts, wherein the valve has a valve body, wherein the valve body is commonly biased in a direction in which the communication flow path is in the first state by a biasing force of a biasing member, and is displaced in a direction in which the communication flow path is the second state in resistance to the biasing force in a case where a difference in pressure between the communication flow path on a suction hole side of the valve and the communication flow path on a negative pressure generating unit side of the valve, wherein the second flow path part comprises a second path formed separately than the first flow path which flows through the valve disposed between the communication flow path on the suction hole side against the valve and the communication flow path on the negative pressure generating unit side against the valve, and wherein the valve comprises a plate-shaped member and is supported on both sides in a direction that is approximately perpendicular to at least one direction by a support part that is supported on both sides in at least the one direction by a base body of the plate-shaped member, and wherein the second flow path part is a through hole configured to the plate-shaped member forming the valve.

8. An image forming apparatus that forms an image on a sheet, the image forming apparatus comprising the sheet adsorption device according to claim 7.

9. A transport device that transports a sheet by adsorbing the sheet to a sheet adsorbing surface, the transport device comprising:

a moving part of the sheet adsorbing surface; and the sheet adsorption device according to claim 7.

10. An image forming apparatus that forms an image on a sheet, the image forming apparatus comprising the transport device according to claim 9.

* * * * *